United States Patent [19]

Antunez

[11] Patent Number: 4,965,891

[45] Date of Patent: Oct. 30, 1990

[54] SAFETY LATCH FOR A TOILET TANK VALVE

[76] Inventor: Bruce A. Antunez, 1143 Indian Springs, Glendora, Calif. 91740

[21] Appl. No.: 333,061

[22] Filed: Apr. 3, 1989

[51] Int. Cl.[5] ..... E03D 1/36

[52] U.S. Cl. ..... 4/366; 4/415; 137/410; 137/420

[58] Field of Search ..... 4/366, 415; 137/410, 137/420, 421, 429

[56] References Cited

U.S. PATENT DOCUMENTS 3,254,665 6/1966 Bachli et al. ..... 137/432 X 4,351,071 9/1982 Clar ..... 4/366 X 4,843,657 7/1989 Orr ..... 4/415 X

*Primary Examiner*—Charles E. Phillips

*Attorney, Agent, or Firm*—Donald D. Mon

[57] ABSTRACT

A tank valve for a toilet tank is controlled by an axially vertically movable float. A releasable latch holds the float in an upper position which closes the tank valve to flow, and prevents opening of the valve to flow except when an intended mechanical flush operation is made. This prevents refill of the tank to replace water which has leaked out, rather than being released for the flushing operation.

1 Claim, 1 Drawing Sheet

SAFETY LATCH FOR A TOILET TANK VALVE

FIELD OF THE INVENTION

This invention relates to toilet tank valves, and in particular to prevention of opening of the valve to flow except as the consequence of a mechanical flush motion.

BACKGROUND OF THE INVENTION

Tank valves for the purpose of refilling toilet tanks after each flush cycle are well-known. They are customarily controlled by a float mechanism which opens the valve to refill the tank when its water level is too low, and closes the valve when the tank has been refilled to a correct depth.

The classical flush control is a flush valve at the bottom of the tank which is opened to release the stored water. The float follows the water level and keeps the valve open to flow until after the tank has emptied and has been refilled. The flush valve is customarily opened by lifting it with a chain or cable connected to a flush lever or handle actuated by the user.

A problem arises with this system when water leaves the tank as the consequence of loss of water for some reason other than the intentional opening of the flush valve. Examples are loss of water through a leaking flush valve, or through a crack in the tank itself. In these situations, the tank valve opens to replace the lost water even though the water was not used in a flushing cycle.

In the case of a leaking flush valve the consequences are waste of water, and the distraction caused by hearing the valve open when no one has flushed the system.

In the case of a cracked thank, instead of merely losing one tankful of water, usually drained onto the floor, water will continue to be supplied until the situation is noticed, and this may be after considerable damage has been done, especially in multi-storage buildings. To this is added the distraction, especially noticed at night, of tank refill operation when the system was not in fact flushed.

It is an object of this invention to provide means which prevent the opening of the tank valve except as the consequence of a mechanical flush motion.

BRIEF DESCRIPTION OF THE INVENTION

This invention is used in combination with a tank valve which utilizes a sleeve-like inverted cup as a float. The float rises and falls along a vertical axis to control a tank valve mounted inside the float. When the float is in a lower position as the consequence of a lower water level, the tank valve will open to flow. When the buoyant float is raised to a level corresponding to a full tank, the tank valve will close, and remain closed to flow until the water level is again lowered.

According to this invention a releasable latch means mechanically holds the float in its upper position, and keeps it there until it is released by a mechanical flush motion. Thus, unless the system is mechanically actuated, no water will be supplied to the tank even if the water in the tank has all or partly leaked out.

The above and other features of this invention will be fully understood from the following detailed description and the accompanying drawings, in which:

DETAILED DESCRIPTION OF THE INVENTION

Although this invention may be utilized with any tank valve which has a vertically moving float, it has its first and presently most pertinent use with a tank valve of the type shown in Roosa U.S. Pat. No. 4,341,238. This Roosa patent is incorporated herein by reference in its entirety for its showing of such a valve, of its structural details, and of its operation. Only those features necessary to an understanding of this invention will be given here. For additional details, reference may be made to the Roosa patent.

Figure 2:
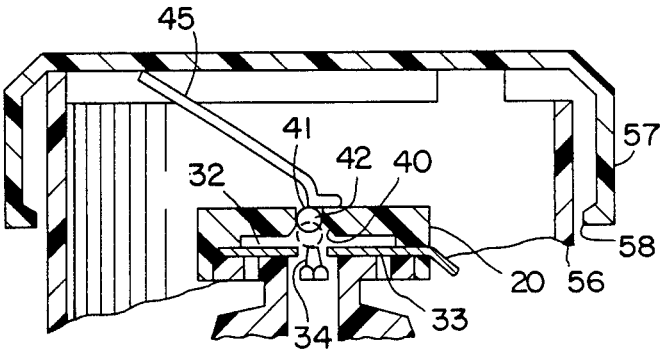
FIG. 2 is an enlarged portion of FIG. 1, showing the valve in its closed-to-flow.

FIG. of this instant patent will be recognized as FIG. 2 of the Roosa patent, modified to include this invention. FIG. 2 of this instant patent application will be recognized as the upper portion of Roosa's FIG. 3, foreshortened and with a portion of the invention added.

Tank valve 10 is mounted to the bottom 11 of a tank (not shown). A spud 12 and seal 13 fit riser 14 in an aperture 15 in the bottom of the tank. The riser extends vertically upwardly to supply water under pressure to the valving mechanism 20 of the tank valve. This mechanism has a downwardly extending ported neck which is threadedly attached to the top of the riser. The valve has a body 22.

A supply passage 23 through the neck interconnects the riser passage to a valve seat 24. A spider 25 holds a post 26 in passage 23, rising above the valve seat. Valve seat 24 represents the inlet port of the valve.

A valving chamber 30 in the body is divided into a lower flow portion 31 and an upper bias portion 32. A diaphragm 33 extends across the valving chamber to divide it into these portions. A bleed port 34 in the diaphragm has a diameter larger than that of the post so that the bleed port is always open to flow.

Figure 1:
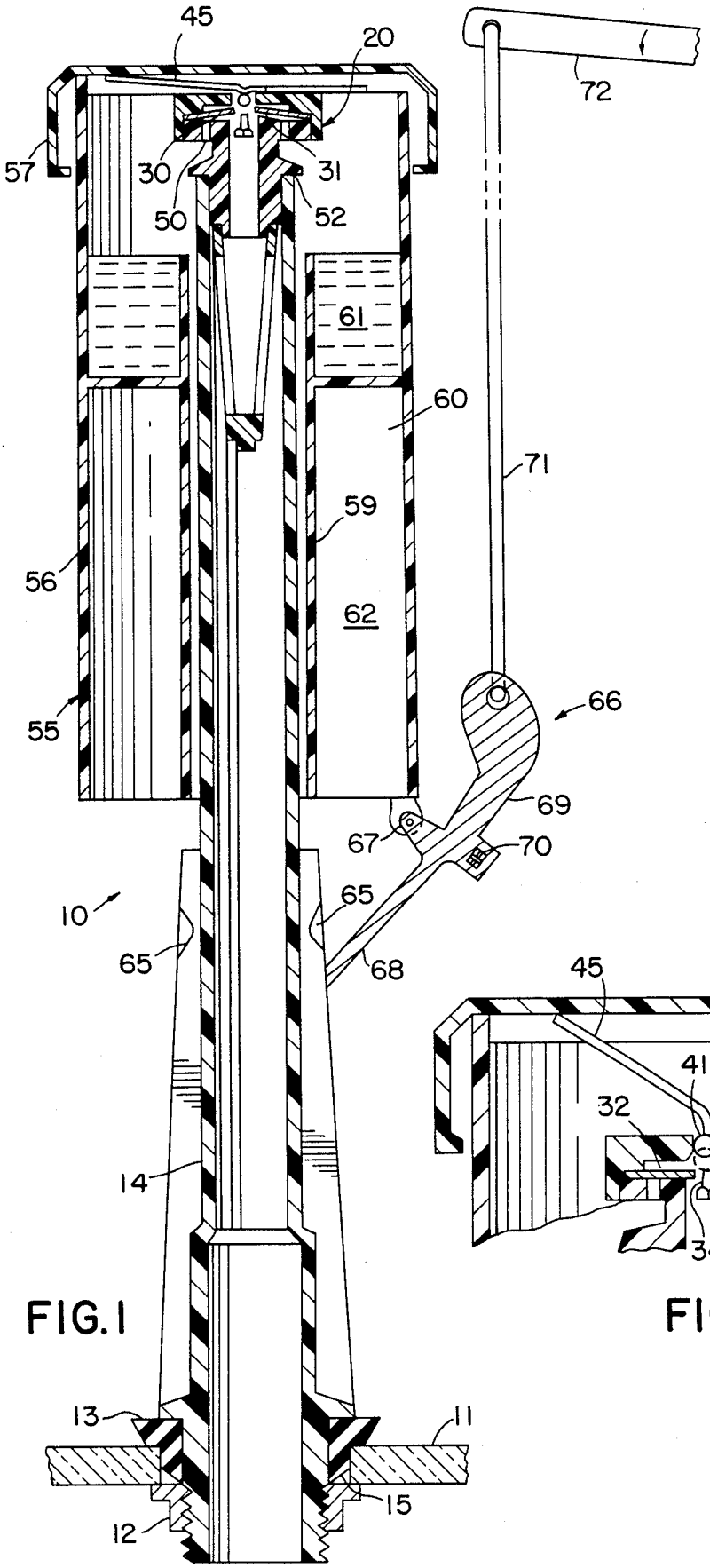
FIG. 1 is a side view, partly in axial cross-section, showing the presently-preferred embodiment of the invention, with the tank valve in its open-to-flow condition, and the latch means unlatched.
Figure 3:
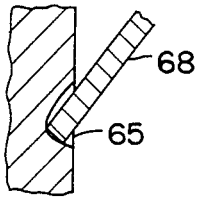
FIG. 3 is a fragment showing portions of the tank valve with the latch means in its latched condition.

A vent port 40 extends through the top of the valve. A peripheral seat 41 extends around it. A ball 42 rests against seat 41 as shown in FIG. 3 to close port 40 when the valve is under pressure and is to be in its closed to flow condition. A pivoted actuator arm 45 with a contactor on it permits the ball to reach this position (FIG. 2) unless pressed down (FIG. 1) to open the vent port.

Outlet ports 50 from flow portion 31 direct water downwardly around the neck (or around the riser, which is its equivalent). A shoulder 52 is formed around the neck below the outlet ports.

Control of this valve is accomplished by a float 55 in the shape of an inverted cup. The float is movable along a vertical axis coincident with that of the riser. The cup has a peripheral sidewall 56 and a cap 57. Gaps 58 are formed between them to release air and water from the top.

An internal sleeve 59 extends from the bottom of the float to an intermediate upper level. In between, a disc-like partition 60 forms an intermediate upper load region 61, open at its top to receive water and closed at its bottom to retain it. A bouyant chamber 62 is formed below the partition, closed at its top an open at its bottom to retain air to tend to lift the float in opposition to the weight of the float plus the weight of water in the load chamber.

The Roosa construction is modified by forming a notch 65 in the wall of the riser. A latch 66 is pivotally mounted to the float at its bottom edge by a hinge 67. The latch has a pawl 68 and a lever 69. Because it is intended to be self-biased so the pawl presses against the riser, it is made sufficiently heavy that it will tend to assume that position. If desired, a weight 70 can be included in it.

A lift chain 71 or cable is attached to lever 69, and to flush arm 72. The flush arm is connected to a flush lever or handle (not shown) in the customary manner. It will also be connected to the flush valve to open it.

When the float is in its upper position, the pawl is in the notch as shown in FIG. 3. The float cannot move down and open the valve to flow, even if the water level lowers.

To flush the system, the flush handle is turned to lift flush arm 72. This will pull the cable upwardly and remove the pawl from the notch. The float can then move downwardly. The flush arm will be released, and by the time the latch returns to contact with the riser, the pawl will be below the notch. It will slide along the riser, without impeding the downward movement of the float. In fact in the Roosa valve the float moves only a relatively small distance, usually less than an inch. This is because the cup rests on the valve workings in its lowermost position with its bottom edge above the water level, and shuts off the valve as the consequence of moving up only far enough to enable the ball to re-close the vent port.

The inherent bias of the latch will assure that the pawl enters the notch when the uppermost position again is reached.

This invention thereby provides a simple expedient to limit the loss of water occasioned by causes other than an actual intended flusing procedure.

This invention is not to be limited by the embodiment shown in the drawings and described in the description, which is given by way of example and not of limitation, but only in accordance with the scope of the appended claims.

I claim:

1. A toilet tank water inlet valve of the type having a riser with a vertical axis, a valving mechanism atop the riser, and an inverted cup-type float, having a bottom edge, said float surmounting said valving mechanism to open the valve mechanism to flow when the float moves axially on said riser to a lower level and to close the valve mechanism to flow when the float moves axially on said riser to an upper level, the improvement comprising:

a releasable latch comprising a pawl at one end and a lever at the opposite end and being pivotally mounted to said bottom edge between said pawl and lever, said lever being weighted such that it tends to rotate one end of said pawl about said pivotal mount into contact with said riser, said riser including a notch into which said end can engage to hold the cup at an upper extreme and to prevent downward movement of the cup unless said one end of said pawl is withdrawn from said notch, said pawl and lever permitting free downward sliding movement of said cup relative to the riser except when said one end of said pawl is engaged in said notch, and a flexible linkage attached at one end to said lever and attached to a flush lever at the other end such that only normal operation of said flush lever will disengage said one end of said pawl from said notch.

* * * * *